US011268234B2

(12) United States Patent
Jang et al.

(10) Patent No.: US 11,268,234 B2
(45) **Date of Patent: *Mar. 8, 2022**

(54) LAUNDRY MACHINE HAVING INDUCTION HEATER AND CONTROL METHOD OF THE SAME

(71) Applicant: LG Electronics Inc., Seoul (KR)

(72) Inventors: Jaehyuk Jang, Seoul (KR); Sangwook Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 152 days.

This patent is subject to a terminal disclaimer.

(21) Appl. No.: 16/709,438

(22) Filed: Dec. 10, 2019

(65) Prior Publication Data

US 2020/0181830 A1 Jun. 11, 2020

(30) Foreign Application Priority Data

Dec. 10, 2018 (KR) ..... 10-2018-0158561

(51) Int. Cl.
*D06F 58/30* (2020.01)
*D06F 34/28* (2020.01)
(Continued)

(52) U.S. Cl.
CPC ..... *D06F 58/30* (2020.02); *D06F 29/005* (2013.01); *D06F 33/00* (2013.01); *D06F 34/28* (2020.02);
(Continued)

(58) Field of Classification Search
CPC ..... D06F 58/30; D06F 58/08; D06F 58/10; D06F 58/26; D06F 58/38; D06F 34/28;
(Continued)

(56) References Cited

U.S. PATENT DOCUMENTS 8,347,520 B2 * 1/2013 Kuwabara ..... D06F 58/206 34/73
8,627,689 B2 * 1/2014 Finch ..... G06Q 50/06 68/12.12
(Continued)

FOREIGN PATENT DOCUMENTS

DE 102009026646 12/2010
EP 3034672 6/2016
(Continued)

OTHER PUBLICATIONS

Extended European Search Report in European Application No. 19214409.5, dated Mar. 13, 2020, 8 pages.
(Continued)

*Primary Examiner* — Stephen M Gravini
(74) *Attorney, Agent, or Firm* — Fish & Richardson P.C.

(57) ABSTRACT

A laundry machine includes a tub; a drum that is rotatably mounted in the tub and holds laundry; an induction heater that is provided in the tub and configured to heat an outer circumferential surface of the drum located in opposite; a motor that is configured to drive so as to rotate the drum; a temperature sensor that is configured to sense the temperature inside the tub; and a processor that is implemented to control drum RPM in spinning based on a preset spinning target RPM and control heat-spinning based by controlling the drive of the induction heater, wherein the processor controls the drive of the induction heater by setting a heating target temperature that is raised by the drive of the induction heater to be higher as the preset spinning target RPM is set to be lower.

20 Claims, 6 Drawing Sheets

(51) Int. Cl.

| | |
|---|---|
| ***D06F 29/00*** | (2006.01) |
| ***D06F 33/00*** | (2020.01) |
| ***D06F 39/14*** | (2006.01) |
| ***D06F 58/08*** | (2006.01) |
| ***D06F 58/10*** | (2006.01) |
| ***D06F 58/26*** | (2006.01) |
| ***D06F 105/46*** | (2020.01) |
| ***D06F 103/00*** | (2020.01) |
| ***D06F 103/08*** | (2020.01) |
| ***D06F 103/34*** | (2020.01) |
| ***D06F 103/44*** | (2020.01) |
| ***D06F 105/28*** | (2020.01) |
| ***D06F 58/38*** | (2020.01) |
| ***D06F 101/00*** | (2020.01) |
| ***D06F 103/16*** | (2020.01) |
| ***D06F 105/48*** | (2020.01) |
| ***D06F 103/24*** | (2020.01) |

(52) U.S. Cl.
CPC ..... *D06F 39/14* (2013.01); *D06F 58/08* (2013.01); *D06F 58/10* (2013.01); *D06F 58/26* (2013.01); *D06F 58/38* (2020.02); *D06F 2101/00* (2020.02); *D06F 2103/00* (2020.02); *D06F 2103/08* (2020.02); *D06F 2103/16* (2020.02); *D06F 2103/24* (2020.02); *D06F 2103/34* (2020.02); *D06F 2103/44* (2020.02); *D06F 2105/28* (2020.02); *D06F 2105/46* (2020.02); *D06F 2105/48* (2020.02)

(58) Field of Classification Search
CPC .... D06F 29/005; D06F 33/00; D06F 2105/46; D06F 2105/28; D06F 2103/00; D06F 2103/08; D06F 2103/34; D06F 2103/44; D06F 2101/00; D06F 2202/04; D06F 2204/065; D06F 2204/04
USPC ..... 34/527, 595–610
See application file for complete search history.

(56) References Cited

U.S. PATENT DOCUMENTS

| | | | | |
|---|---|---|---|---|
| 9,255,358 | B2 * | 2/2016 | Kim | D06F 58/24 |
| 10,472,761 | B2 * | 11/2019 | Pistochini | D06F 58/30 |
| 11,028,527 | B2 * | 6/2021 | Vaive | D06F 29/005 |
| 2004/0006829 | A1 * | 1/2004 | Kim | D06F 33/36 8/150 |
| 2018/0057995 | A1 | 3/2018 | Kim et al. | |
| 2020/0181830 | A1 * | 6/2020 | Jang | D06F 29/005 |
| 2020/0190726 | A1 * | 6/2020 | Jang | D06F 37/36 |
| 2020/0190727 | A1 * | 6/2020 | Kim | D06F 58/30 |
| 2020/0190728 | A1 * | 6/2020 | Noh | D06F 33/00 |
| 2020/0224350 | A1 * | 7/2020 | Kim | D06F 58/46 |
| 2020/0224351 | A1 * | 7/2020 | Jang | D06F 39/04 |
| 2021/0164151 | A1 * | 6/2021 | Kim | D06F 58/26 |

FOREIGN PATENT DOCUMENTS

| | | | | |
|---|---|---|---|---|
| EP | 3375930 | | 9/2018 | |
| EP | 3680382 | A1 * | 7/2020 | D06F 37/42 |
| JP | 2009082258 | | 4/2009 | |
| JP | 2010022497 | | 2/2010 | |
| KR | 1020180103515 | | 9/2018 | |
| WO | WO2018038580 | | 3/2018 | |
| WO | WO-2020145675 | A1 * | 7/2020 | D06F 39/04 |

OTHER PUBLICATIONS

PCT International Search Report and Written Opinion in International Application No. PCT/KR2019/017273, dated Apr. 16, 2020, 12 pages.

* cited by examiner

LAUNDRY MACHINE HAVING INDUCTION HEATER AND CONTROL METHOD OF THE SAME

CROSS-REFERENCE TO RELATED APPLICATION

This application claims the benefit of priority to Korean Application No. 10-2018-0158561, filed on Dec. 10, 2018, the contents of which is incorporated by reference in its entirety.

FIELD

Embodiments of the present disclosure relate to a laundry machine, more particularly, a laundry machine which may heat a drum by means of an induction heater, and a control method of the same.

BACKGROUND

A laundry machine includes a tub (or an outer tub) that holds wash water; and a drum (or an inner tub) rotatably mounted in the tub. Laundry is loaded in the drum and washed by a washing detergent and wash water as the drum is rotated.

To improve a washing effect by promoting the activation of the washing detergent and the decomposition of contaminants, high-temperature washing water is supplied to the tub or washing water is heated in the tub. For that, a heater mounting portion is formed in a bottom of the tub in a recess shape and a heater may be mounted in the heater mounting portion. Such a heater is usually a sheath heater.

Washing is completed with the completion of spinning. The spinning means that the water contained in the laundry by using a centrifugal force of the drum rotating at a high rotation speed. After the completion of the spinning, a user may dry the laundry naturally or using a dryer. Accordingly, it is recommended to remove much as from the laundry during the spinning cycle as possible. In other words, the water content may be lowered as much as possible.

However, if increasing the duration of the spinning, the amount of the water separated from the laundry by the centrifugal force is restricted. So, it is conventional to determine a spinning RPM and a spinning time to be between energy consumption and spinning efficiency.

To enhance the spinning efficiency, heat-spinning may be performed. The heat-spinning means a technique invented to lower the water content of the laundry by raising the temperature of the wash water during the spinning and weakening the viscosity of the water contained in the laundry.

The point of heating for the heat-spinning may be when the spinning is performed after a preliminary heating or heating is performed during the spinning. As another example, the heating may be performed both before starting the spinning and while the spinning is performed.

Such the heat-spinning may be performed in a laundry apparatus having both washing and drying functions. In other words, the laundry apparatus having the washing and drying functions may include a heater configured to heat air for such the heat-spinning as well as a sheath heater configured to heat wash water. Here, such the laundry apparatus having the washing and drying functions may include a fan and a duct that are provided to supply heated-air to a drum.

A material has a property that a stress causing deformation is lowered as the temperature rises. As a spinning RPM rises, the stress applied to a system (e.g., a tub and a bearing) also rises. Accordingly, the system is likely to be deformed at a high RPM as the temperature rises. Considering system stability, the maximum value of the heating temperature in the heat-spinning may be set based on the maximum RPM. In other words, the uppermost limit of the heating temperature is preset and the heat-spinning is performed based on the uppermost limit. As one example, when the maximum target RPM of the spinning is 1200 RPM in the laundry apparatus, the uppermost limit of the heating temperature may be preset to be 60° C.

Accordingly, since one fixed temperature uppermost limit, in other words, one temperature limit is used, heating will not be performed at the one temperature limit or more even though additional heating is possible, which will end up with a low efficiency. Especially, even though additional heating is possible at a low RPM, the heating is not performed at the temperature uppermost limit or more and the efficiency cannot but deteriorate. A laundry machine includes a tub (or an outer tub) that holds wash water; and a drum (or an inner tub) rotatably mounted in the tub. Laundry is loaded in the drum and washed by a washing detergent and wash water as the drum is rotated.

To improve a washing effect by promoting the activation of the washing detergent and the decomposition of contaminants, high-temperature washing water is supplied to the tub or washing water is heated in the tub. For that, a heater mounting portion is formed in a bottom of the tub in a recess shape and a heater may be mounted in the heater mounting portion. Such a heater is usually a sheath heater.

Washing is completed with the completion of spinning. The spinning means that the water contained in the laundry by using a centrifugal force of the drum rotating at a high rotation speed. After the completion of the spinning, a user may dry the laundry naturally or using a dryer. Accordingly, it is recommended to remove much as from the laundry during the spinning cycle as possible. In other words, the water content may be lowered as much as possible.

However, if increasing the duration of the spinning, the amount of the water separated from the laundry by the centrifugal force is restricted. So, it is conventional to determine a spinning RPM and a spinning time to be between energy consumption and spinning efficiency.

To enhance the spinning efficiency, heat-spinning may be performed. The heat-spinning means a technique invented to lower the water content of the laundry by raising the temperature of the wash water during the spinning and weakening the viscosity of the water contained in the laundry.

The point of heating for the heat-spinning may be when the spinning is performed after a preliminary heating or heating is performed during the spinning. As another example, the heating may be performed both before starting the spinning and while the spinning is performed.

Such the heat-spinning may be performed in a laundry apparatus having both washing and drying functions. In other words, the laundry apparatus having the washing and drying functions may include a heater configured to heat air for such the heat-spinning as well as a sheath heater configured to heat wash water. Here, such the laundry apparatus having the washing and drying functions may include a fan and a duct that are provided to supply heated-air to a drum.

A material has a property that a stress causing deformation is lowered as the temperature rises. As a spinning RPM rises, the stress applied to a system (e.g., a tub and a bearing) also rises. Accordingly, the system is likely to be deformed at a high RPM as the temperature rises. Considering system stability, the maximum value of the heating temperature in the heat-spinning may be set based on the maximum RPM. In other words, the uppermost limit of the heating temperature is preset and the heat-spinning is performed based on the uppermost limit. As one example, when the maximum target RPM of the spinning is 1200 RPM in the laundry apparatus, the uppermost limit of the heating temperature may be preset to be 60° C.

Accordingly, since one fixed temperature uppermost limit, in other words, one temperature limit is used, heating will not be performed at the one temperature limit or more even though additional heating is possible, which will end up with a low efficiency. Especially, even though additional heating is possible at a low RPM, the heating is not performed at the temperature uppermost limit or more and the efficiency cannot but deteriorate.

DETAILED DESCRIPTION OF THE INVENTION

Technical Problem

To overcome the disadvantages, an object of the present disclosure is to address the above-noted and other problems.

Another object of the present disclosure is to provide a laundry machine that may apply a convection heating method using an induction heater so as to solve the problem of the conventional heating, spinning and/or drying method using the heated-air, and a control method of the same.

A further object of the present disclosure is to provide a laundry machine that may secure a good spinning performance by effectively reducing a water content even at a low RPM of a drum, and a control method of the same.

A still further object of the present disclosure is to provide a laundry machine that may effectively secure a spinning performance even in a washing environment requiring low noise and low vibration, and a control method of the same.

A still further object of the present disclosure is to provide a laundry machine that may secure stability by varying a temperature limit based on a target RPM set for heat-spinning and enhance user satisfaction for spinning and drying, and a control method of the same.

A still further object of the present disclosure is to provide a laundry machine that may perform heat-spinning even without a drying function, and a control method of the same.

A still further object of the present disclosure is to provide a laundry machine that may effectively perform spinning and drying in a washing environment and a drying environment, which require low noise and low vibration, by performing drying after heat-spinning, and a control method of the same.

A still further object of the present disclosure is to provide a laundry machine having no drying function that may enhance a spinning performance and end a heat-spinning at a proper temperature, once condensing water and lowering the temperature of the water, together with heat-spinning, and a control method of the same.

A still further object of the present disclosure is to provide a laundry machine that may perform a drying function without a fan configured to circulate air, a duct and an additional heater configured to heat air, and a control method of the same.

Technical Solution

To achieve these objects and other advantages and in accordance with the purpose of the embodiments, as embodied and broadly described herein, Embodiments of the present disclosure may provide a laundry machine comprising a tub; a drum that is rotatably mounted in the tub and holds laundry; an induction heater that is provided in the tub and configured to heat an outer circumferential surface of the drum located in opposite; a motor that is configured to drive so as to rotate the drum; a temperature sensor that is configured to sense the temperature inside the tub; and a processor that is implemented to control drum RPM in spinning based on a preset spinning target RPM and control heat-spinning based by controlling the drive of the induction heater, wherein the processor controls the drive of the induction heater by setting a heating target temperature that is raised by the drive of the induction heater to be higher as the preset spinning target RPM is set to be lower.

Specifically, the processor may control the drive of the induction heater by varying a target temperature based one a preset spinning target RPM. The processor may drive the induction heater and pause the drive of the induction heater, when the temperature inside the tub reaches a heating target temperature. Accordingly, when the induction heater is driven with the same output with respect to the same load amount, the high heating target temperature may mean that the entire heat amount supplied to the load (e.g., the laundry) is much.

Because of that, the heat amount supplied to the laundry may be set to be larger as the spinning target RPM is lower.

The processor may control the induction heater to be driven while the drum is rotating in the spinning. Heat might not be transferred to the laundry in a specific area of the heated drum such that drum overheating might occur and such heating may be unnecessary.

The temperature sensor may be provided in a bottom of the tub, especially, a front side of the tub. Here, the temperature sensor may be spaced a preset distance apart from the bottom.

The processor may pause the drive of the induction heater, when the temperature of the air sensed by the temperature sensor reaches the heating target temperature.

The preset target RPM may include at least three stages, and the target temperature may be set to be lower at the same intervals of the three stages, as the preset target RPM rises each one step. The interval may be 10° C. or 5° C.

The laundry machine may further comprise a control panel configured for user interface.

The control panel may comprise a heat-spinning selection unit configured to allow a user to select whether to perform the heat-spinning.

The control panel may include a spinning/temperature selection unit that is configured to allow a user to select a plurality of spinning target RPMs or respective heating target temperatures corresponding to the spinning target RPMs.

The control panel may include a display that is configured to display a plurality of spinning target RPMs and respective heating target temperatures corresponding to the spinning target RPMs.

The control panel may include a course selection unit that is configured to allow a user to select one of the washing courses and a normal spinning option unit that is configured to allow the user to change a spinning target RPM preset in the washing courses.

Accordingly, the user may select various types of the spinning cycle that influences noise and vibration most.

The control panel may include a heat-spinning option unit that is configured to allow the user to select whether to perform the heat-spinning. When a specific one of the washing courses is selected and then the heat-spinning option unit is selected, the processor sets the heating target temperature based on the spinning target RPM preset in the specific course.

The control panel may include a heat-spinning selection unit that is configured to allow the user to select whether to perform the heat-spinning. When a specific course is selected from the washing courses and a specific target RPM is selected from the normal spinning option unit and the heat-spinning unit is selected, the processor may set the heating target temperature based on a specific target RPM that is selected from the normal spinning option unit.

The processor may control the overall duration time of the induction heater in the heat-spinning to be less than a preset time period.

The preset time period may be set to be longer based on the amount of the laundry.

The processor may control the induction heater to restart when the temperature falls to a preset temperature or less after reaching the heating target temperature.

The laundry machine may further comprise a door that is open and closed to facilitate communication between the drum inside and the drum outside; and a door locking mechanism that is configured to maintain the closed state of the door, wherein the processor controls the door locking mechanism to maintain the locked state of the door when the temperature sensed by the temperature sensor is a preset temperature or more after the completion of the heat-spinning.

The laundry machine may further comprise a duct that connects a front upper area of the drum with a rear upper area of the tub to circulate air; and a fan that is provided in the duct and generates air circulation.

The laundry machine may include a coolant valve configured to supply a coolant to the tub or an air circulation duct. The coolant valve may be driven to lower the temperature or condense moisture inside the tub or during the heat-spinning or after the heat-spinning. In addition, when a drying function is provided, the coolant valve may be driven to condense moisture in the drying cycle.

When the drying facilitated by air circulation is preset to be performed after the completion of the washing, the heat-spinning may be performed by default after the completion of the washing and the drying is then performed.

A target temperature in the drying may be set to be a lower one of a target temperature in the heat-spinning that is determined by the spinning target RPM or a temperature that is preset to maintain the door locking.

Embodiments of the present disclosure also provide a control method of a laundry machine comprising a tub; a drum that is rotatably mounted in the tub and holds laundry; an induction heater that is provided in the tub and configured to heat an outer circumferential surface of the drum located in opposite; a motor that is configured to drive so as to rotate the drum; and a temperature sensor that is configured to sense the temperature inside the tub, the control method comprising setting a spinning target RPM; setting a heating target temperature that is raised by the drive of the induction heater to be higher as the preset spinning target RPM is lower; and performing heat-spinning based on the spinning target RPM and the heating target temperature.

Further scope of applicability of the present disclosure will become apparent from the detailed description given hereinafter. However, it should be understood that the detailed description and specific examples, while indicating preferred embodiments of the disclosure, are given by illustration only, since various changes and modifications within the spirit and scope of the disclosure will become apparent to those skilled in the art from this detailed description.

Advantageous Effects

The present disclosure has the effect of providing a laundry machine that may secure a good spinning performance by effectively reducing a water content even at a low RPM of a drum, and a control method of the same.

In addition, the present disclosure has the effect of providing a laundry machine that may effectively secure a spinning performance even in a washing environment requiring low noise and low vibration, and a control method of the same.

In addition, the present disclosure has the effect of providing a laundry machine that may secure stability by varying a temperature limit based on a target RPM set for heat-spinning and enhance user satisfaction for spinning and drying, and a control method of the same.

In addition, the present disclosure has the effect of providing a laundry machine that may perform heat-spinning even without a drying function, and a control method of the same.

In addition, the present disclosure has the effect of providing a laundry machine that may effectively perform spinning and drying in a washing environment and a drying environment, which require low noise and low vibration, by performing drying after heat-spinning, and a control method of the same.

In addition, the present disclosure has the effect of providing a laundry machine having no drying function that may enhance a spinning performance and end a heat-spinning at a proper temperature, once condensing water and lowering the temperature of the water, together with heat-spinning, and a control method of the same.

In addition, the present disclosure has the effect of providing a laundry machine that may perform a drying function without a fan configured to circulate air, a duct and an additional heater configured to heat air, and a control method of the same.

DESCRIPTION OF SPECIFIC EMBODIMENTS

Figure 1:
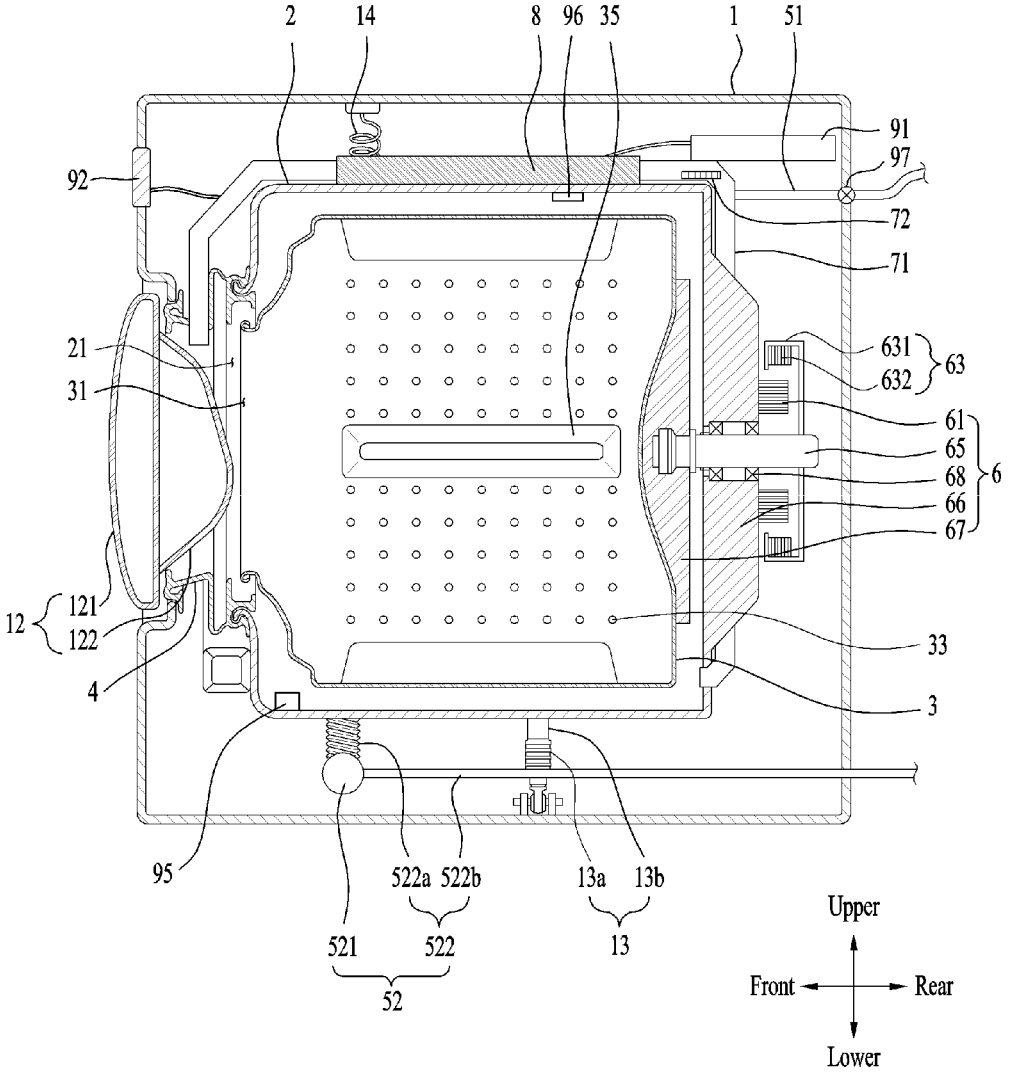
FIG. 1 is a sectional diagram illustrating a laundry machine according to one embodiment of the present disclosure.

Hereinafter, referring to FIG. 1, a laundry machine according to one embodiment of the present disclosure will be described.

Regardless of numeral references, the same or equivalent components may be provided with the same reference numbers and description thereof will not be repeated.

For the sake of brief description with reference to the drawings, the sizes and profiles of the elements illustrated in the accompanying drawings may be exaggerated or reduced and it should be understood that the embodiments presented herein are not limited by the accompanying drawings.

The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

The laundry machine according to one embodiment may include a cabinet 1 that defines an exterior design; a tub 2 provided in the cabinet; and a drum 3 that is rotatably mounted in the tub 2 and holds laundry (e.g., washing objects, drying objects and refreshing objects). As one example, when washing clothes by means of wash water, the laundry may be washing objects. When drying the washed-clothes by means of heated-air, the laundry may be drying objects. When refreshing dried-clothes by means of heated-air, cool air or steam, the laundry may be refreshing objects. Accordingly, a washing, drying or refreshing process for clothes may be performed in the drum 3 provided in the laundry machine.

The cabinet 1 may have a cabinet opening provided in a front side of the cabinet 1 to introduce the laundry and a door 12 rotatably coupled to the cabinet to open and close the cabinet opening.

The door 12 may include a circular door frame 121 and a transparent window 122 provided in a center area of the door frame.

In this instance, as defining directions to help a specific structure of the washing machine which will be described later to be understood easily, a direction towards the door 12 with respect to the center of the cabinet 1 may be defined as a front direction.

Also, the reverse of the direction towards the door 12 may be defined as a rear direction. Right and left directions may be naturally defined with respect to the front and rear directions defined above.

The tub 12 may be formed in a cylindrical shape with a longitudinal axis that is oriented in parallel with a bottom of the cabinet or keeps a tilted state by an angle of 0-30 degrees with respect to the bottom, and define a predetermined space for storing water. The tub 12 may include a tub opening 21 that is in communication with the cabinet opening.

The tub 2 may be fixed to a lower surface (or the bottom) of the cabinet 1 by a lower support 13 including a support bar 13*a* and a damper 13*b* connected with the support bar 13*a*. Accordingly, the vibration generated in the tub 2 by the rotating drum 3 may be suspended or damped.

In addition, an flexible supporting portion 14 fixed to an upper surface of the cabinet 1 may be connected with an upper surface of the tub 2 so as to dampen the vibration transferred to the cabinet 1 from the tub 2.

The drum 3 may be formed in a cylindrical shape with a longitudinal axis that is in parallel with or tilted an angle of 0-30 degrees with respect to the lower surface (or the bottom) of the cabinet 1. The drum 3 may include a drum opening 31 formed in a front side and communicable with the tub opening 21. The angle formed by the central axis of the tub 2 and the central axis of the drum 3 with respect to the bottom may be equal.

The drum 3 may include a plurality of through-holes 33 penetrating an outer circumferential surface of the drum 3 such that air and wash water may flow between the inside of the drum 3 and the inside of the tub 2 via the through-holes 33.

A lifter 35 may be further provided in an inner circumferential surface of the drum 3 to agitate the laundry during the rotation of the drum. The drum 3 may be rotatable by a drive unit 6 provided in a rear side of the tub 2.

The drive unit 6 may include a stator 61 fixed to the rear surface of the tub 2; a rotor 63 that is rotatable based on an electromagnetic interaction with the stator; and a shaft 65 provided to connect the drum 3 and rotor 63 with each other via the rear surface of the tub 2.

The stator 61 may be fixed to a rear surface of a bearing housing 66 that is provided in the rear surface of the tub 2. The rotor 63 may be configured of a rotor magnet 632 that is provided in an outer area with respect to a radial direction of the stator and a rotor housing 631 provided to connect the rotor magnet 632 and the shaft 65 with each other.

The bearing housing 66 may include a plurality of bearings 68 that are supports the shaft 65.

A spider 67 may be provided in the rear surface of the drum 3 to transfer the rotational force of the rotor 63 to the drum 3 smoothly and the shaft 65 may be fixed to the spider 67 to transfer the rotational power of the rotor 63.

Meanwhile, the laundry machine according to the embodiment may further include a water supply hose 51 that is configured to receive water from an outer water supply source. The water supply hose 51 may form a channel configured to supply water to the tub 2.

In addition, a gasket 4 may be provided between the cabinet opening and the tub opening 21. The gasket 4 may be configured to prevent water leakage from the tub to the cabinet 1 and the vibration of the tub 2 from being transferred to the cabinet 1.

Meanwhile, the laundry machine according to the embodiment may further include a water discharge unit 52 configured to discharge the water held in the tub 2 outside the cabinet 1.

The water discharge unit 52 may include a water discharge pipe 522 that forms a water discharge channel of the water held in the tub 2 and a water discharge pump 521 configured to generate a pressure different inside the water discharge pipe 522.

More specifically, the water discharge pipe 522 may include a first water discharge pipe 522*a* provided to connect the lower surface of the tub 2 and the water discharge pump 521 with each other; and a second water discharge pipe 522*a* having one end connected with the water discharge pump 521 to form a channel of water flowing outside the cabinet 1.

In addition, the laundry machine may further include a heating unit 8 that is configured to induction-heat the drum 3.

The heating unit 8 may be mounted to a circumferential surface of the tub 2 and configured to induction-heat a circumferential surface of the drum 3 by means of a magnetic field that is generated once an electric current is applied to a coil having wires wounded there around. Accordingly, it can be said that the heating unit is an induction heater. Once such an induction heater is driven, the circumferential surface of the drum that is located in opposite to the induction heater 9 may be heated to a very high temperature soon.

The heating unit 8 may be controlled by a controller 9 fixedly provided in the cabinet 1 and the controller 9 may be configured to control the driving of the heating unit 8 to control the temperature inside the tub. The controller 9 may include a processor configured to control the drive of the laundry machine and an inverter processor configured to control the heating unit. In other words, the drive of the laundry machine and the drive of the heating unit 8 may be controlled by using one processor.

However, to prevent the overload of the processor and enhance control efficiency, a processor for controlling the drive of the laundry machine and another processor for controlling the drive of the heating unit are provided independently, while they are communication-connected with each other.

A temperature sensor 95 may be provided in the tub 2. The temperature sensor 95 may be connected to the controller 9 to transmit information about temperatures inside the tub 2 to the controller 9.

The temperature sensor 95 may be provided near the bottom of the tub inside. Accordingly, the temperature sensor 95 may be located lower than the lowermost area of the drum. In FIG. 1, the temperature sensor 95 is provided in contact with the bottom of the tub. However, it may be spaced a preset distance apart from the bottom. That is to allow wash water or air to surround the temperature sensor so as to measure the temperature of the wash water or air. Although mounted through the tub from the bottom to the top, the temperature sensor 95 may be mounted through the tub from the front side to the rear side. In other words, it may penetrate the front side (or the surface that forms the tub opening), not the circumferential surface of the tub.

Accordingly, when the laundry machine is operated to heat wash water by means of the induction heater 8, the temperature sensor may sense whether the wash water is heated to a target temperature or not. The drive of the induction heater may be controlled based on the result of the temperature sensing.

In addition, when all of the wash water is discharged, the temperature sensor 95 may sense the temperature of air. Specifically, the temperature of the air heated by the induction heater 8, in other words, a drying temperature may be sensed. Accordingly, the temperature sensor may sense whether the air is heated to a target temperature and the drive of the induction heater may be controlled based on the result of the temperature sensor's sensing.

Meanwhile, the laundry machine according to one embodiment may include a drying temperature sensor 96. The drying temperature sensor 96 may have a different installation position and a different temperature measuring object from the above-noted temperature sensor 95.

The drying temperature sensor 96 may be located in an upper area of the tub 2 and near the induction heater 8. In other words, the drying temperature sensor 96 may be provided in an inner surface of the tub 2 to sense the temperature of the outer circumferential surface of the drum 3 that is located in opposite. While the temperature sensor 95 mentioned above is configured to sense water or air nearby, the drying temperature sensor 96 may be configured to sense the temperature of the drum.

Since the drum 3 is a rotatable element, the temperature of air near the outer circumferential surface of the drum 3 may be sensed to sense the temperature of the outer circumferential surface indirectly.

The temperature sensor 95 may be provided to determine whether to maintain the drive of the induction heater until the target temperature or to change the output of the induction heater. The drying temperature sensor 96 may be provided to determine whether the drum is overheated. When it is determined that the drum is overheated, the drive of the induction heater may be forcedly.

The laundry machine according to one embodiment may have a drying function. In this instance, the laundry machine according to the embodiment may be a laundry machine having washing and drying functions or a washing machine having a drying function. For that, the laundry machine may further include a fan 72 configured to blow air into the tub 2; and a duct 71 in which the fan 72 is installed. Here, even unless such components are additionally provided, the drying function may be performed. In other words, air may be chilled in the inner circumferential surface of the tub and moisture may be condensed to be discharged. That is, the moisture condensation may be performed even without the air circulation so as to perform the drying function. To enhance drying efficiency by more effective moisture condensation, a coolant may be supplied to the tub. It is better when a surface area where the coolant meets the tub, in other words, where the coolant contacts with air is broader. For that, the coolant may be supplied while spreading broadly from the rear surface or some area of the tub or both lateral surfaces of the tub. Such supply of coolant may flow along an inner surface of the tub, not to be drawn into the drum. Accordingly, the duct or fan for the drying may be omitted such that the laundry machine may be manufactured and assembled easily.

In this instance, it is not necessary to provide an additional heater for the drying. In other words, the induction heater 8 may be used in performing the drying. Specifically, one induction heater may be used in heating wash water during the washing, heating the laundry during the spinning and heating the drying objects during the drying.

Once the induction heater 8 is driven together with the drum 3, the entire area of the outer circumferential surface of the drum may be substantially heated. The heated drum may exchange heat with the wet laundry and the laundry may be heated. Of course, air inside the drum may be heated. Accordingly, when supplied to the drum 3, air may be heat-exchanged and the air having moisture evaporated there from may be discharged outside the drum 3. In other words, air may be circulated between the duct 71 and the drum 3. Here, the fan 72 may be driven for the air circulation.

An air supply position and an air discharge position may be determined to uniformly supply air to the drying objects or washed clothes and smoothly discharge humid air. For that, air may be supplied from a front upper area of the drum 3 and discharged from a rear lower area of the drum, in other words, a rear lower area of the tub.

The air discharged via the rear lower area of the tub may flow along the duct 71. Moisture may be condensed from the humid air by the condensate supplied to the duct 71 through a condensate channel 51 formed in the duct 71. When moisture is condensed from the humid air, the humid air may be changed into low-temperature dry air and such low-temperature dry air may be flowing along the duct 71 and re-supplied to the drum 3.

Since air is not heated directly, the temperature of the heated-air may be lower than the heated-air in the conventional heater heating dryer. Accordingly, an effect of preventing damage or deformation of clothes that might be caused by the high temperature may be expected. Also, the clothes may be overheated in the drum heated at the high temperature.

However, the induction heater is driven together with the drum as mentioned above and the clothes repeatedly rise and falls as the drum is driven. Also, a heating position of the drum is located in the upper area of the drum, not the lower area. Accordingly, the overheating of the clothes may be effectively prevented.

A control panel 92 may be provided in a front or top surface of the laundry machine. The control panel may be provided for user interface. A user's diverse orders are input to and diverse pieces of information may be displayed on the control panel. In other words, the control panel 92 may include a manipulation unit configured to facilitate the user's manipulation and a display unit configured to display information.

Figure 2:
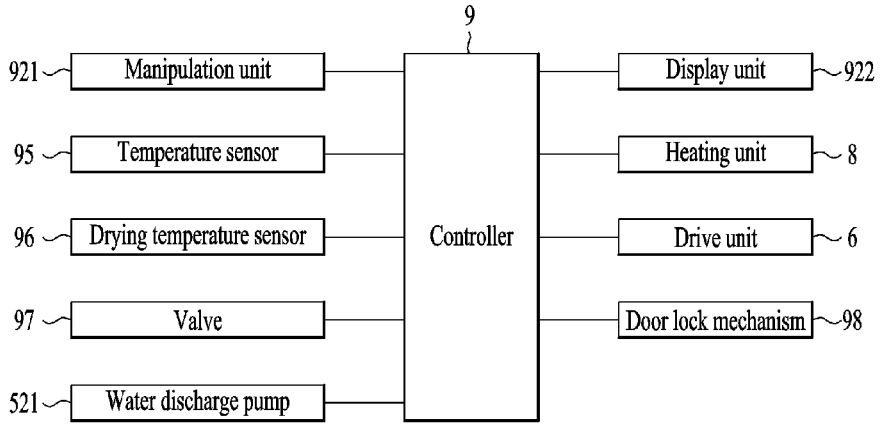
FIG. 2 is a block diagram illustrating a control configuration of a laundry according to one embodiment of the present disclosure.

FIG. 2 is a block diagram of a system that is provided in the laundry machine according to one embodiment.

The controller 9 may be implemented to control the drive of the heating unit, in other words, the induction heater 8 based on the sensing of the temperature sensor 95 and the drying temperature sensor 96. The controller 9 may also control the drive of the drive unit configured to rotate the drum by means of the motor and the drive of the diverse sensors and hardware. The controller 9 may control diverse valves or pumps for the water supply, the water discharge and the coolant supply and the control of the fan.

Especially, the laundry machine according to the embodiment may further include a coolant valve 97 configured to change a high-temperature humid air environment into a low-temperature dry air environment. The coolant valve 97 may supply cold water to the tub or the duct to chill air and condensate moisture from the air.

The water discharge pump 421 may be periodically or intermittently driven during the spinning and/or the coolant supply.

The laundry machine according to the embodiment may include a door lock mechanism 98. The door lock mechanism may be provided to prevent the door from opening during the operation of the laundry machine. According to the illustrated embodiment, the door opening may be limited when the inner temperature is a preset temperature or more during the operation of the laundry machine or even after the operation.

In addition, the controller 9 may control diverse display units 922 that are provided in the control panel 92. The controller 9 may be provided with a signal input from diverse manipulation units 921 that are provided in the control panel 92 and control the overall drive of the laundry machine based on the signal.

Meanwhile, the controller 9 may include a main processor configured to control the conventional drive of the laundry machine and an auxiliary processor configured to control the drive of the induction heater. The main processor and the auxiliary processor may be independently provided and communication-connected with each other.

Figure 3:
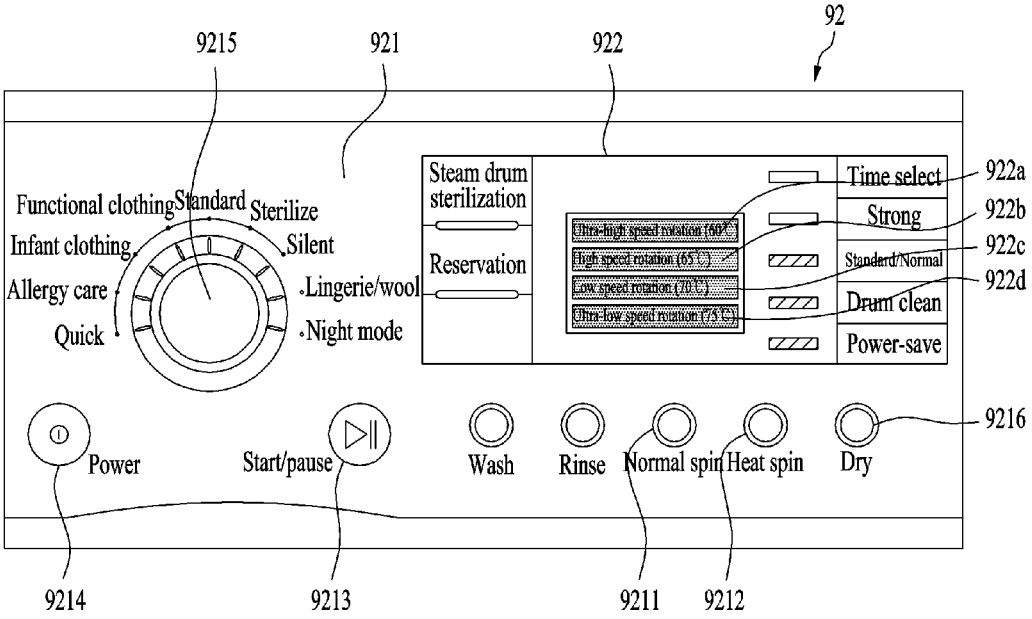
FIG. 3 is a diagram illustrating one example of a control panel provided in a laundry machine according to one embodiment.

FIG. 3 illustrates one example of a front side provided in the control panel 92 including the manipulation unit 921 and the display unit 922.

The manipulation unit 921 may include a course selection unit 9215 to allow the user to select one of the washing courses. The plurality of the washing courses may be diverse based on types of laundry and purposes. The user may select a specific one of the washing courses and the processor may be implemented to perform the selected specific washing course based on preset control logic.

The washing courses may include a washing cycle, a rinsing cycle and a spinning cycle. Such cycles may be sequentially performed and the washing course may be completed. In each one of the washing courses, one or more of a cycle duration, a moving rate of the drum and a spinning RPM may be set to be different.

As one example, the spinning RPM may be preset to be approximately 1000 RPM or 1200 RPM in a normal course or allergy care course. In a silent course, a lingerie/wool course (or a delicate course) and a night mode, the spinning RPM may be set to be approximately 400 RPM to 800 RPM. In a specific course, the spinning RPM may be set to be changeable if necessary. In another specific course, the spinning RPM may be set to be unchangeable.

To change the spinning RPM, a normal spinning option unit 9211 may be provided. In the normal spinning option unit 9211, the user may change the spinning RPM set by the course selection. As one example, when the spinning RPM is set to be 1000 RPM in the normal course by default, the user may change the spinning RPM into 800 RPM through the normal spinning option unit 9211. In this instance, the spinning may be performed to 800 RPM as a target RPM, while the normal course is performed.

Here, the spinning RPM means the target RPM in the spinning cycle. While the drum is rotating at a low RPM, the laundry distribution and rotation is avoided. The rotation of the drum may be maintained for a preset time period at the target RPM after reaching the target RPM finally.

When the washing is performed in a very silent state (e.g., the night mode), the spinning RPM preset by default (e.g., 600 RPM) may be limited to be changed through the normal spinning option unit 9211.

The normal spinning option unit 9211 may allow the user to select one of the spinning RPM steps.

According to this embodiment, a heat-spinning option unit 9212 may be provided. The heat-spinning option unit 9212 may be a selecting unit configured to select whether to heat the clothes by driving the induction heater during the spinning cycle.

When the temperature of the clothes rises, the moisture discharged from the clothes by means of the centrifugal force may be promoted more. Accordingly, the drum rotation together with the heating may promote the spinning efficiency more than only the drum rotation.

The user may select one specific course via the course selection unit 9212 and also select the heat-spinning option unit 9212 to enhance the spinning efficiency. Here, the user may select the heat-spinning option unit 9212 just to perform heating during the spinning of the elected specific course. However, the processor may set the heating target temperature by the drive of the induction heater to be different based on the spinning target RPM of the selected specific course.

Specifically, as the preset spinning target RPM is higher, the heating target temperature may be set to be lower. In the reverse, as the spinning target RPM is lower, the heating target temperature may be set to be higher.

As mentioned above, the spinning target RPM may be preset in a specific course, which is selected through the course selection unit 9215, by default. Such the preset spinning target RPM may be preset after changed via the normal spinning option unit 9211. Accordingly, once the heat-spinning is selected, the heating target temperature may be set based on the current spinning target RPM preset finally.

The spinning target RPM may include a plurality of steps 922*a*, 922*b*, 9322*c* and 922*d*. as one example, those steps may be provided as 800 RPM, 1000 RPM, 1200 RPM and 1400 RPM. The heating target temperatures may be preset to be 75° C., 70° C., 65° C. and 60° C. for those steps, respectively. In FIG. 3, the spinning target RPM steps and the respective heating target temperatures set for them are shown. The spinning target RPM may be displayed as RPM value or qualitative expression (e.g., an ultra-high speed, a high speed, a low speed and an ultra-low speed).

When the display unit 922 is realized as a touch display, the user may select the spinning target RPM and the heating target temperature through the display unit 922. Here, when a specific heating option through the heating spinning option unit 9212 is selected, the selected spinning target RPM and heating target temperature may be displayed on the display unit 922.

In this instance, such the steps may be classified into more specific ones or three ones or less. When the spinning target RPM is classified into three steps as occasion rises, the heating target temperature may be set to have a difference of 10° C.

When needing to perform washing late at night or in quite a silent state, the user may select the silent course or the night mode course through the course selection unit 9215. In such the courses, the moving rate of the drum (or the rate of the time when the drum is substantially rotating in a drum operation section) may be lowered to minimize noise during the washing. Here, the duration of the washing may be increased in comparison with the other courses so as to secure the washing performance.

While the washing performance may be secured in such the night mote course or the silent course, it is difficult to secure spinning performance. Since noise and vibration are likely to occur during the spinning at a high rotation number, the spinning target RPM is set to be low in such the courses. When it is approximately 1200 RPM or more in the normal courses, the spinning target RPM may be approximately 800 RPM in such the courses.

Accordingly, much moisture remains in the clothes after the spinning such that the user may determine that sufficient spinning is not performed.

However, according to this embodiment, the heating target temperature may be even raised when the spinning is performed at a low target RPM such that the spinning performance may be enhanced by the raised temperature. In other words, the moisture discharge promoted by the moisture evaporation may be performed as well as the moisture discharge promoted by the centrifugal force.

During the spinning, the wash water may be basically discharged from the tub. Specifically, there is little wash water that remains in the tub, because the wash water is discharged. Accordingly, when the induction heater is operated to heat the drum and the clothes, the temperature inside the tub may rise. At this time, the temperature sensor 95 may sense the temperature inside the tub. In other words, the processor is implemented to stop the driving of the induction heater to end the heating, once determining that the temperature sensor 95 senses the heating target temperature. When the driving of the induction heater is stopped, the temperature may be lowered in the tub. Accordingly, the temperature inside the tub falls to a preset temperature or less, for example, 5° C. from the heating target temperature, the drive of the induction heater may re-start. Once the heating temperature reaches the heating target temperature again, the drive of the induction heater may be stopped.

Basically, the processor 9 may drive the induction heater 8 while the drum is being driven. The drive of the drum and the drive of the induction heater may be synchronized. However, in this instance, fabric damage from heat is likely to occur at a point of drum rotation starting or ending. That is because the induction heater may heat the drum to a very high temperature in a moment and the drum rotation RPM is very low at the point of the drum rotation starting and ending such that the contact time between the drum and the clothes may be increased.

The tumbling mode of the drum may be performed between 40~60 RPM. At this time, the clothes may repeatedly rise and fall. Accordingly, the start point of the induction heater driving may be later than the start point of the drum rotating. As one example, when it takes approximately 1 second for the drum RPM to reach a tumbling RPM after the drum rotating starts and accelerate, a start point of the induction heater driving may be approximately 0.5 second after the drum rotating starts. Here, the induction heater driving may start once the drum RPM reaches the tumbling RPM.

However, the time taken to reach the heating target may become shorter than the heating time. Accordingly, to prevent the fabric damage from heat and secure the sufficient heating time simultaneously, the processor may control the induction heater to be driven before the drum RPM reaches the tumbling RPM once the drum rotating starts (or the motor is switched on). For that, the driving point of the induction heater may be set for the drum rotation to be performed for a preset time period or for the drum RPM to reach a preset RPM.

An algorithm configured to disperse the laundry and avoid resonance by repetition of the drum rotation and pausing may be applied to the spinning. In other words, the drum RPM may be accelerated from the starting of the spinning and reach the spinning target RPM and then the spinning may not be performed.

Accordingly, the spinning cycle may be classified into an initial spinning and a late spinning. The late spinning is a section in which the drum is rotating at the spinning target RPM to perform the spinning seriously. Once the late spinning completes, the spinning may end. The initial spinning may be section in which the late real spinning is prepared. In the initial spinning, the drum may be drive at a middle RPM that is lower than the final spinning target RPM to determine whether the laundry distribution and resonance occur because the drum is rotated at the lower RPM. The times taken to perform such processes may be changeable based on the laundry distribution and the laundry amount.

The heat-spinning may be performed when heating is excluded in the late spinning after the induction heater is driven to the heating target temperature in the initial spinning. At this time, even unless the drum RPM reaches the heating target temperature after the initial spinning, the late spinning may be performed. That is because the initial spinning stage may enter into the late spinning stage in a moment.

The heat-spinning may be performed when the induction heater is driven to the heating target temperature in the late spinning. At this time, the heat-spinning may end right after the late spinning. After that, the spinning time may be reduced in the heating environment and the user may not take out the clothes immediately, because the heated temperature has to be lowered.

The heat-spinning may be performed during the initial spinning and the late spinning. In this instance, the duration of the heating environment may be increased more is more likely to reach the heating target temperature. Also, it is more likely to reach the heating target temperature in an early state of the late spinning, not right before the end of the late spinning. Accordingly, it is more likely to take out the clothes right after the spinning.

The laundry machine according to this embodiment may be a washer having no drying function. Nevertheless, the heat-spinning may be performed by means of the induction heater 8. Especially, the heat-spinning may be performed when the spinning is performed at a low spinning RPM such that a more efficient spinning effect may be expected in the night wash mode course or the silent course. Such an effect will not be realized in the conventional laundry machine.

The present application of Korean Patent No. 10-2017-0101333 (hereinafter, "the cited application") discloses a laundry machine including an induction heater. Accordingly, the technical features disclosed in the cited application may be applied to the embodiment of the present disclosure, far as not exclusive and contrary to the present disclosure. Especially, the induction heater structure or the mounting structure and the coolant supply structure may be applied to the embodiment of the present disclosure equivalently.

The drum, the clothes and the air inside the tub and the drum may be heated by the induction heater. Of course, the water contained in and discharged from the clothes may be heated. Accordingly, the air inside the tub and the drum may become high-temperature humid air. The humid environment after the spinning may be maintained as it is. To prevent that, a coolant may be supplied to the inner surface of the tub.

Specifically, the coolant may flow along the rear surface or lateral surface of the tub so as to condense moisture from the high-temperature humid air. The condensed water may be discharged from the tub, together with the water collected from the clothes during the spinning.

The coolant valve may be periodically or intermittently open during the heat-spinning to remove moisture from the air and perform the heat-spinning more effectively. Also, the high-temperature humid environment after the spinning may be changed into a low-temperature dry environment easily. Such the coolant might cause an error in the sensing of the temperature sensor. Accordingly, the temperature sensor may be provided in a front lower area of the tub, because the coolant will contact with air on the rear surface or rear side surface of the tub to be discharged via the rear lower area of the tub.

The laundry machine according to the present embodiment may be a laundry machine having washing and drying functions. In this instance, the laundry machine may further include a duct and a fan that are provided to circulate air forcibly. Different from the conventional washing machine, the laundry machine according to the present disclosure requires no additional heater for the drying such that the overall system may become very simple. It is important in the laundry machine having the drying function to condense moisture from the humid air. Such moisture condensation may be performed in a space defined in the additional duct, not the space defined in the tub.

The coolant may be supplied to the duct, not the tub. The moisture may be condensed from the air that is chilled when the coolant falls from an upper area in a portion of the duct that is upwardly extended from a lower area of the tub.

Such the duct and the chilling structure may facilitate the change of the high-temperature humid environment in the tub and the drum, once the heat-spinning or drying is completed, into the low-temperature dry environment.

In the laundry machine having the drying function, the drying may be performed, independent from the washing, or automatically performed after the washing.

As one example, the course selection unit 9215 may include a course configured to serially perform the washing cycle and the drying cycle. When the drying function is provided as a basic option, the user may select a washing course and a drying course from the course selection unit 9215 and the drying option unit 9216. Once the selected course is completed, the drying may be automatically performed. Accordingly, the washing, rinsing, spinning and drying cycles may be sequentially and automatically performed.

When the user selects only the drying option 9216, only the drying cycle may be performed.

The user may apply power to the laundry machine through a power selection unit 9214 and then load drying objects or clothes into the drum 3. After that, the user may select diverse courses and options from the course selection unit 9215 and the option unit 9211, 9212 and 9216. Hence, when the user selecting a start/pause selection unit 9213, the laundry machine may be put into operation based on the control logic selected by the user.

Figure 4:
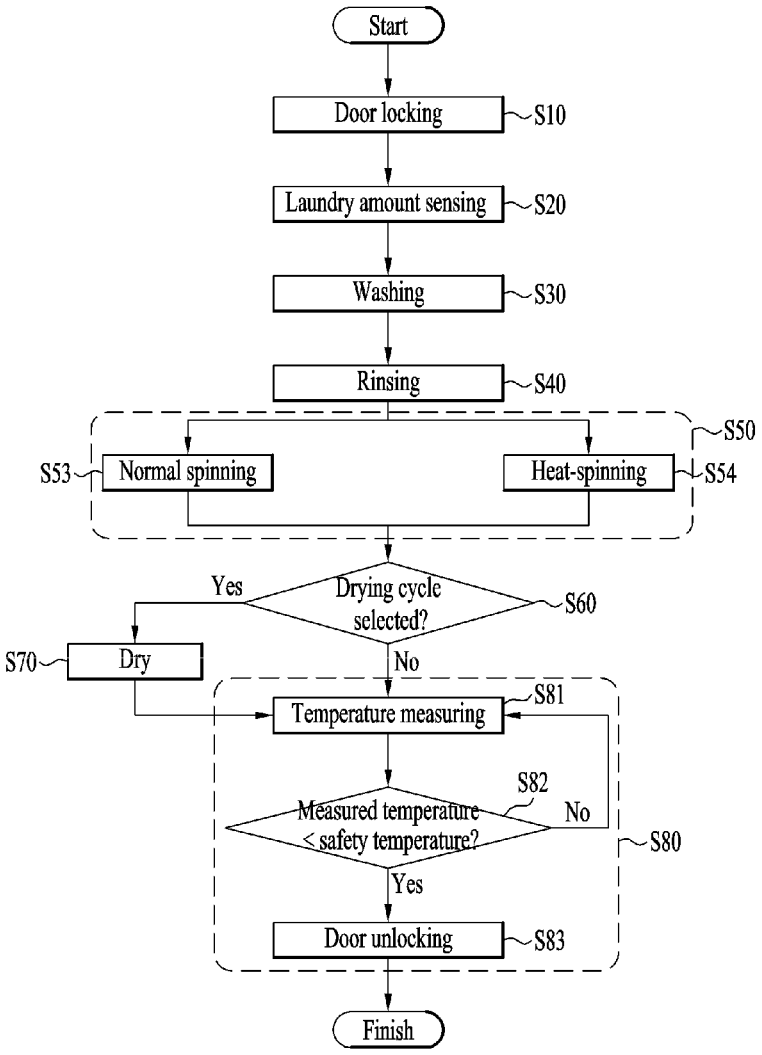
FIG. 4 is a diagram illustrating one example of a control method of a laundry machine according to one embodiment.
Figure 5:
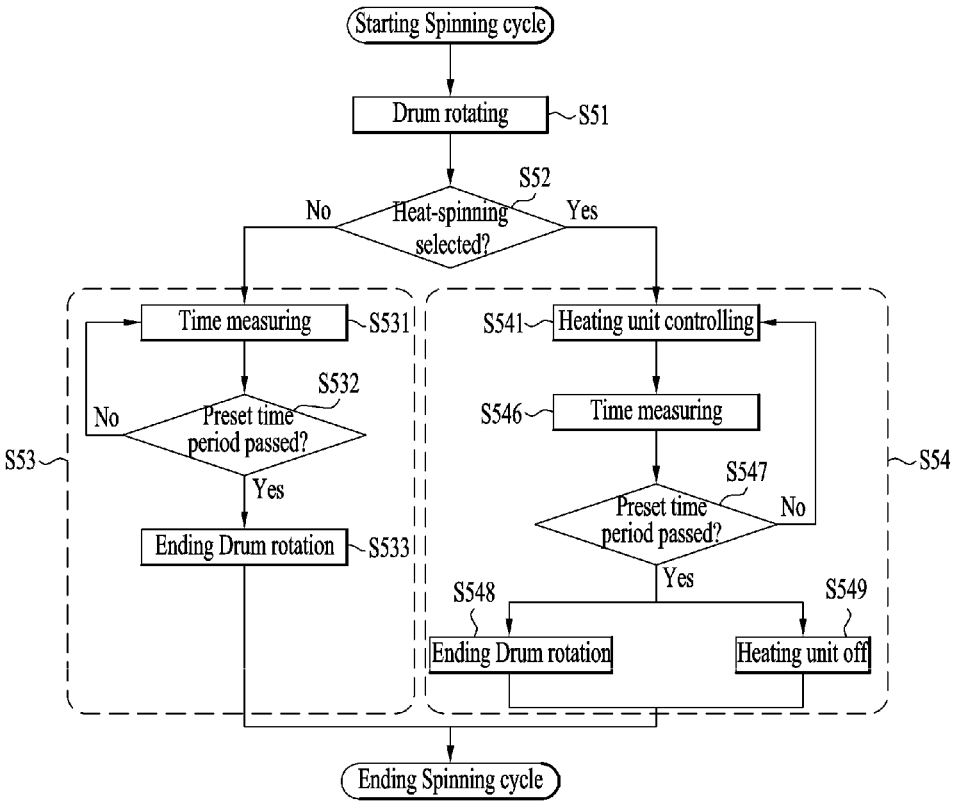
FIG. 5 is a diagram illustrating a spinning cycle according to one example of the control method.

Hereinafter, referring to FIGS. 4 and 5, a control method of the laundry machine according to one embodiment will be described in detail. FIG. 4 is one example of a control flow for a washing course including a washing or drying course. FIG. 5 is one example of a control flow for the spinning shown in FIG. 4.

When the user inputs the pause/start after completing the selection, door locking S10 may be performed first and laundry amount sensing S20 may be performed after that. Hence, washing S30 and rinsing S40 may be performed based on the sensed laundry amount.

When the user selects the washing course, spinning S50 may be performed after the rinsing S40. In other words, the drum may be rotated at a high speed and moisture may be removed from the laundry. Normal spinning S53 or heat-spinning S54 may be performed based on the user's selection or non-selection (or by default).

Each of the normal spinning and the heat-spinning may include the initial spinning and the late spinning. Different from the normal spinning, the heat-spinning may be configured to heat both the drum and the laundry by means of the induction heater in the middle of the spinning cycle.

Once the user selects the heat-spinning or drying option, the spinning cycle may perform the heat-spinning. When the user selects only the washing course or the normal spinning, the spinning cycle may perform the normal spinning.

In the normal spinning S53, the maximum duration time may be preset. Accordingly, time counting S531 may be performed after the spinning starts and it may be determined whether a preset time period passes S532. After that, the drum rotation may end S533 and the spinning cycle may end.

Even in the heat-spinning S54, the maximum duration time may be preset. Accordingly, heat-spinning time counting S546 may be performed and it may be determined whether a preset time period passes S547. After that, the drum rotation may end S548 and the spinning cycle may end. The control of the heating unit, in other words, the drive of the heating unit S541 may be performed after the drum drive starts. The heating unit drive may be performed intermittently, periodically or continuously. Here, the heating unit drive may be paused once the temperature reaches the heating target temperature. When the temperature falls, the heating unit drive may be continued.

Meanwhile, in the spinning cycle, the maximum duration time may be set for each of the initial spinning and the late spinning. As the drum RPM reaches the target RPM and the drum is rotated in the late spinning, the preset late spinning time may be equal to the maximum allowed time. Here, the preset time may be variable based on the laundry amount. However, the initial spinning may be the step that tries to enter into the late spinning and the initial spinning might fail to enter into the late spinning when occasion occurs. In this instance, the initial spinning might be performed for a long time period. Once the maximum allowed initial spinning time passes, the spinning cycle may end without entering into the late spinning. Accordingly, the preset time period in F532 and S547 may be the late spinning duration time once the late spinning starts.

Door unlocking S83 may be performed right after the spinning S50 ends and the operation of the laundry machine may be completed. In other words, the washing course may be completed. However, when the heat-spinning S50 is performed, the temperatures inside the tub and the drum are likely to be high after the completion of the spinning. At this time, when the user opens the door, the heat discharged outside might cause the user's uncomfortable feeling or a safety accident. Accordingly, the temperature inside the tub may be measured after the spinning S81 and it may be determined whether the measured temperature is higher or lower than a preset temperature S82. When the measured temperature is lower than the preset temperature, the door unlocking S83 may be performed. In other words, the processor may maintain the door locked state by means of the door lock mechanism, when it is determined based on the result that the temperature inside the tub is higher than the preset temperature.

At this time, when the measured temperature is higher than the preset temperature, the temperature sensing may be repeated while only the drum is driven. However, the temperature may not fall a sufficiently low value only with the drum driving. Accordingly, the temperature inside the tub may be forcibly lowered by the supply of the coolant mentioned above.

Meanwhile, when the drying is selected based on the result of the determination about whether the drying cycle is selected after the spinning cycle S60, in other words, the drying cycle is selected in the laundry machine having the washing and drying functions, drying S70 may be performed. The door unlocking may be performed once the temperature is measured after the completion of the drying.

In the heat-spinning S50, the induction heater may be consistently, repeatedly or intermittently driven until the temperature sensed by the temperature sensor 95 reaches the heating target temperature. The heating target temperature may not be preset as one fixed temperature but set to be variable based on a target RPM in the spinning. A higher heating target temperature may be set at a low target RPM to raise the temperature even with a lower spinning performance facilitated by the centrifugal force so as to secure sufficient spinning performance. Sufficient spinning performance may be achieved at a high target RPM but even the relatively low temperature for heating is added such that more effective spinning performance can be gained.

Meanwhile, the overall driving time of the induction heater during the heat-spinning may be preset. In other words, the maximum drive time may be preset. Unless laundry dispersion is performed properly, the clothes (e.g., socks) provided in the drum might generate big eccentricity enough to increase the initial spinning time. In some specific cases, the late spinning might not be performed, because the eccentricity as prerequisite for entering into the late spinning could not be solved.

Accordingly, the driving of the induction heater may be controlled by means of the heating target temperature and the maximum drive time of the induction heater may be set so as to secure stability. The heater driving time may be set to be variable based on the amount of the laundry, in other words, the laundry amount. When there is a large amount of laundry, the maximum heater drive time may be set to increase. However, the heating target temperature is irrelevant to the laundry amount and it may be set based on the currently set spinning target RPM, as mentioned above.

The driving of the induction heater may be completed once the temperature reaches the heating target temperature and the temperature inside the tub may go down after that. Accordingly, when the temperature do down to a predetermined temperature, the drive of the induction heater may restart. The overheat may be prevented and the sufficient heating may be performed at the same time.

It is not easy to dry the drying objects sufficiently through the spinning and the heat-spinning. When high-temperature heating is performed in a space that is substantially closed tight, the evaporated moisture will still remain in the space. Because of that, the dehydration performance in the heat-spinning is better than the dehydration performance in the normal spinning. However, it cannot be called "drying". Specifically, when drying performed serially after the spinning, the spinning may be the heat-spinning, not the normal spinning.

That is because the tub, the drum and the drying object are in the heated state during the heat-spinning. Accordingly, it is more effective in enhancing the drying performance to perform the drying after performing the heating during the spinning than perform the heating the heating not until performing the drying.

When a course including drying is selected through the course selection unit or when drying is selected through the drying option unit after a washing course is selected through the course selection unit, the heat-spinning may be performed. In other words, even unless the heat-spinning option unit is selected additionally, the heat-spinning may be performed in the spinning by default. Here, the heating target temperature maybe set based on the current spinning target RPM in the heat-spinning.

Meanwhile, it is conventional that the drying time is longer than the spinning time. Since a preliminary drying is performed during the heat-spinning, the overall drying time may be reduced. In addition, when the drying is completed, the temperature inside the tub may become high and the user cannot open the door immediately. At this time, cold air circulation and/or coolant supply may chill the tub inside enough to facilitate the door open. However, it takes an additional time to chill the door in this instance.

Accordingly, the heating target temperature in the drying may be equal to or lower than the target temperature in the heat-spinning. As one example, the heating target temperature during the drying may be equal to a preset temperature that allows door open.

When the washing and the drying are performed in the night mode course, the heat-spinning may be performed, regardless of the heat-spinning option. At this time, RPM may be relatively low during the heat-spinning and a heating target temperature may be relatively high. As one example, the heating target temperature may be 75° C. The door-open allowing temperature may be 50° C. Once the heat-spinning is completed, the induction heater is driven, together with the air circulation and the coolant supply, to perform the drying. In this instance, a heating target temperature in the drying may be equal to the door-open allowing temperature.

In addition, when the drying is performed in the normal washing course, the spinning may be performed at a relatively high RPM until a heating target temperature of approximately 60° C. Even in this instance, the heating target temperature during the drying may be equal to the door-open allowing temperature.

Accordingly, the door may be open right after the drying is complete. As the drying is performed at a relatively low temperature, fabric deformation or damage may be minimized.

Figure 6:
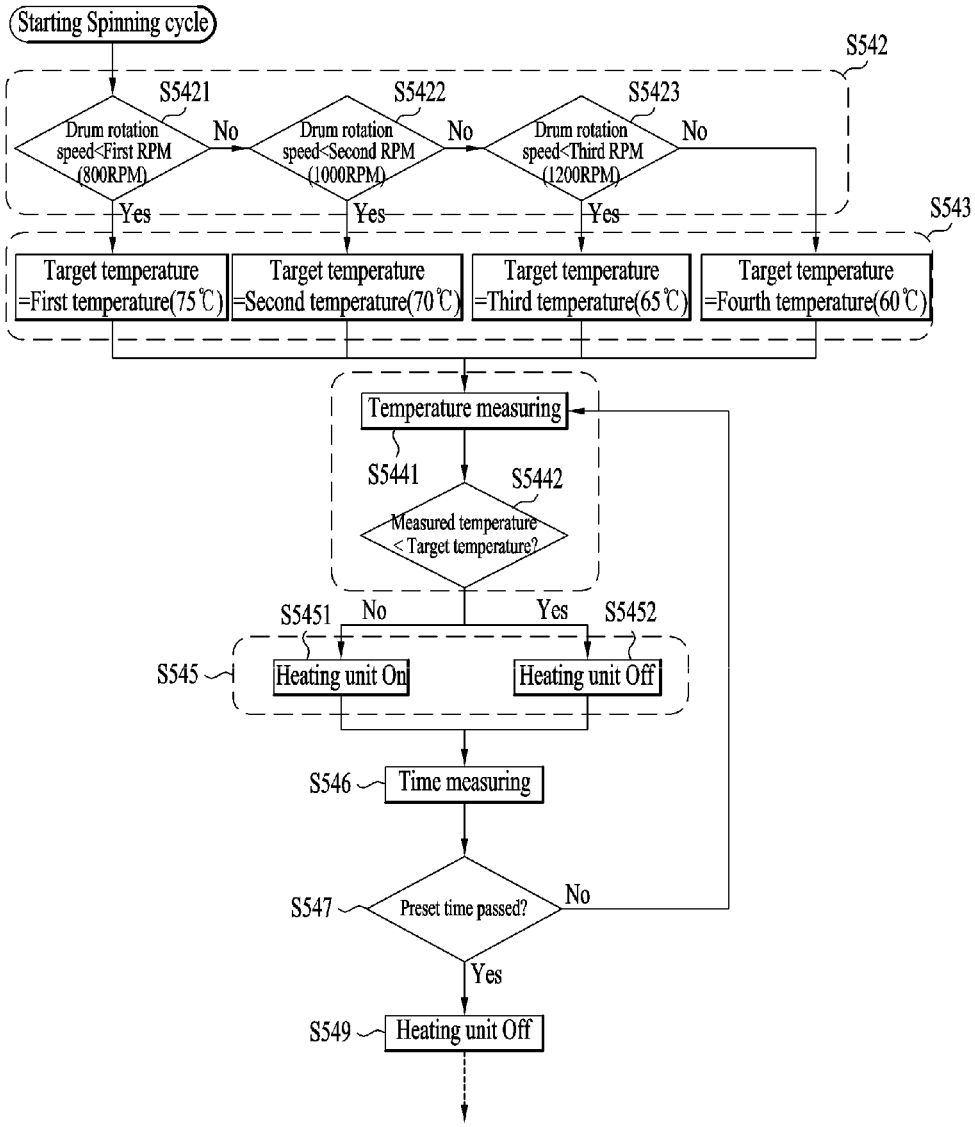
FIG. 6 is a diagram illustrating specific steps that are provided in a heater controlling step of the spinning cycle.

Hereinafter, referring to FIG. 6, the relation between the target spinning RPM and the heating target temperature will be described in detail.

Once the spinning cycle starts, it may be determined whether to perform the heat-spinning (S542). A target spinning RPM and a heating target temperature may be determined in this step. A current target spinning RPM may be detected and the heating target temperature may be machined to the respective current target spinning RPMs to set the target spinning RPM.

Once the drum rotation and the induction heater driving S541 start, S542 may be performed.

The target spinning RPM may be classified into 4 stages as one example. A first RPM may be 800 RPM or less and a second RPM may be 1000 RPM or less. A third RPM may be 1200 RPM or less and a fourth RPM may be more than 1200 RPM. The heating target temperature may be set based on the current target spinning RPMs S543. As one example, the heating target temperature may be set to be 75° C., 70° C., 65° C. and 60° C. for the four stages, respectively. In other words, as the target spinning RPM become lower, the heating target temperature may be set to be higher.

When the current RPM reaches a predetermined RPM or after a predetermined time period as soon as or after the drum is driven, the induction heater may be driven to perform the heat-spinning.

Temperature measuring S5441 may be performed during the heat-spinning and it is checked whether the measured temperature reaches a heating target temperature. When the measured current temperature reaches the heating target temperature, the drive of the induction heater may be paused S5452. Unless it reaches the heating target temperature, the drive of the induction heater may be maintained S5451.

The drive control of the induction heater may be performed until the end of the heat-spinning and the end of the heat-spinning may be performed on a time basis. In other words, it may be determined whether a preset time period passes S547 and the drive of the induction heater may finally end after the preset time period, only to complete the heat-spinning.

The above embodiment may include a step S543 of setting the heating target temperature to be higher as the preset spinning target RPM becomes lower based on the step of setting the spinning target RPM S542 and the preset spinning target RPM. In addition, the embodiment may include a step of performing the heat-spinning based on the set spinning target RPM and the heating target temperature.

According to this embodiment, the heating may be performed by heating the outer circumferential surface of the drum by means of the induction heater. Specifically, the outer circumferential surface of the drum may be heated by using the induction heater, not the heated-air or the heated-air circulation, such that a specific configuration (e.g., only the drum), not the entire system, may be heated. Accordingly, the heating of the configuration that consists of the tub, the bearing housing, the shaft and the bearing may be minimized when the induction heater is driving. Heat durability of those configurations may not be deteriorated. Especially, the drum may be fabricated of stainless steel such that it may be more durable in heat. Even though the drum is heated even to a high temperature at a relatively low spinning RPM, the drum will have no durability and reliability deterioration. Accordingly, an effect of the drying time and the drying energy reduction may be expected in the following drying, when the drying is set to be performed.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds, are therefore intended to be embraced by the appended claims.

What is claimed is:

1. A laundry machine comprising:

a tub;

a drum that is rotatably mounted in the tub and that is configured to hold laundry;

an induction heater that is located in the tub and configured to heat an outer circumferential surface of the drum;

a motor that is located at a rear side of the tub and that is configured to rotatably drive the drum;

a processor that is configured to control driving of the drum based on a preset target spinning speed of the drum, and configured to control a heat-spinning operation by controlling driving of the induction heater; and a temperature sensor that is connected to the processor and that is configured to sense a temperature inside the tub, wherein the processor is configured to control the driving of the induction heater by setting a target heating temperature, wherein the target heating temperature increases as the preset target spinning speed of the drum decreases, and wherein the heat-spinning operation comprises heating the laundry by driving the induction heater during rotation of the drum.

2. The laundry machine of claim 1, wherein the processor is further configured to drive, based on the drum being rotated, the induction heater.

3. The laundry machine of claim 1, wherein the temperature sensor is located at a bottom of the tub.

4. The laundry machine of claim 3, wherein the temperature sensor is located at a front side of the tub.

5. The laundry machine of claim 1, wherein the processor is further configured to, based on the temperature sensed by the temperature sensor reaching the target heating temperature, pause the driving of the induction heater.

6. The laundry machine of claim 1, wherein the preset target spinning speed of the drum comprises at least three stages, the target heating temperature decreases at intervals that align with the at least three stages, and the preset target spinning speed of the drum increases at each of the at least three stages.

7. The laundry machine of claim 1, further comprising:

a control panel that is configured to serve as a user interface, wherein the control panel comprises a heat-spinning option unit that is configured to allow a user to initiate the heat-spinning operation of the laundry machine.

8. The laundry machine of claim 7, wherein the control panel further comprises:

a spinning/temperature selection unit that is configured to allow a user to select a plurality of target spinning speeds of the drum or respective target heating temperatures.

9. The laundry machine of claim 1, further comprising:

a control panel that is configured to serve as a user interface, wherein the control panel comprises a display that is configured to display a plurality of target spinning speeds and respective target heating temperatures.

10. The laundry machine of claim 1, further comprising:

a control panel that is configured to serve as a user interface, wherein the control panel comprises:

a course selection unit that is configured to allow a user to select one of a plurality of washing courses; and a normal spinning option unit that is configured to allow the user to change a target spinning speed that is preset in the selected one of the plurality of washing courses.

11. The laundry machine of claim 10, wherein the control panel further comprises a heat-spinning option unit that is configured to allow the user to initiate the heat-spinning operation of the laundry machine, and wherein, based on a specific one of the plurality of washing courses being selected and then the heat-spinning option unit being selected, the processor is further configured to set the target heating temperature according to the target spinning speed that is preset in the specific washing course.

12. The laundry machine of claim 10, wherein the control panel further comprises a heat-spinning option unit that is configured to allow the user to initiate the heat-spinning operation of the laundry machine, and wherein, based on a specific one of the plurality of washing courses being selected and a specific target spinning speed being selected and a heat-spinning unit being selected, the processor is further configured to set the target heating temperature according to the specific target spinning speed that is selected from the normal spinning option unit.

13. The laundry machine of claim 1, wherein the processor is further configured to control an overall driving time of the induction heater in the heat-spinning operation to be less than a preset time period.

14. The laundry machine of claim 13, wherein the preset time period is proportional to an amount of the laundry.

15. The laundry machine of claim 1, wherein, based on the temperature inside the tub being lower than or equal to a preset temperature, the processor is further configured to control the induction heater to restart.

16. The laundry machine of claim 1, further comprising:

a door that is rotatably coupled to a cabinet of the laundry machine and that is configured to open and close an opening of the cabinet; and a door locking mechanism that is configured to maintain a closed state of the door, wherein, based on the sensed temperature being higher than or equal to a preset temperature, the processor is further configured to control the door locking mechanism to maintain a locked state of the door.

17. The laundry machine of claim 16, further comprising:

a duct that is configured to connect a front upper area of the drum and a rear upper area of the tub to circulate air; and a fan that is located in the duct and that is configured to generate the air circulation.

18. The laundry machine of claim 17, wherein the heat-spinning operation occurs by default after completion of a washing operation and before a drying operation that is facilitated by the air circulation.

19. The laundry machine of claim 18, wherein a target temperature in the drying operation is set to be lower than a target temperature in the heat-spinning operation, wherein the target temperature in the heat-spinning operation is determined by the target spinning speed of the drum or a temperature that is preset to maintain the closed state of the door.

20. A control method of operating a laundry machine comprising a tub; a drum that is rotatably mounted in the tub and that is configured to hold laundry; an induction heater that is located in the tub and configured to heat an outer circumferential surface of the drum; a motor that is located at a rear side of the tub and that is configured to rotatably drive the drum; a processor that is configured to control driving of the drum, and configured to control a heat-spinning operation by controlling driving of the induction heater; and a temperature sensor that is connected to the processor and that is configured to sense a temperature inside the tub, the control method comprising:

setting a target spinning speed of the drum;

increasing a target heating temperature as the preset target spinning speed of the drum reduces; and performing a heat-spinning operation based on the target spinning speed of the drum and the target heating temperature.

* * * * *